US012044249B2

(12) United States Patent
Steiner et al.

(10) Patent No.: US 12,044,249 B2
(45) Date of Patent: Jul. 23, 2024

(54) TWO PIECE SPLIT SCROLL FOR CENTRIFUGAL COMPRESSOR

(71) Applicant: Johnson Controls Tyco IP Holdings LLP, Milwaukee, WI (US)

(72) Inventors: Jordan Q. Steiner, York, PA (US); Paul W. Snell, York, PA (US)

(73) Assignee: TYCO FIRE & SECURITY GMBH, Neuhausen Am Rheinfall (CH)

( * ) Notice: Subject to any disclaimer, the term of this patent is extended or adjusted under 35 U.S.C. 154(b) by 0 days.

(21) Appl. No.: 18/212,050

(22) Filed: Jun. 20, 2023

(65) Prior Publication Data

US 2023/0332619 A1 Oct. 19, 2023

Related U.S. Application Data

(63) Continuation of application No. 16/649,863, filed as application No. PCT/US2018/052259 on Sep. 21, 2018, now Pat. No. 11,680,582.

(Continued)

(51) Int. Cl.
*F04D 29/42* (2006.01)
*F04D 17/10* (2006.01)

(Continued)

(52) U.S. Cl.
CPC ..... *F04D 29/4213* (2013.01); *F04D 17/10* (2013.01); *F04D 29/462* (2013.01); *F04D 29/624* (2013.01); *F25B 2400/07* (2013.01)

(58) Field of Classification Search
CPC . F04D 1/00; F04D 17/08; F04D 17/10; F04D 29/00; F04D 29/002; F04D 29/284;

(Continued)

(56) References Cited

U.S. PATENT DOCUMENTS 2,770,106 A 11/1956 Moody
2,921,445 A 1/1960 Ashley et al.

(Continued)

FOREIGN PATENT DOCUMENTS

CN 1054652 A 9/1991
CN 1213045 A 4/1999

(Continued)

OTHER PUBLICATIONS

Japanese Office Action for JP Application No. 2020-516828, dated Aug. 9, 2022, 8 pgs.

(Continued)

*Primary Examiner* — Courtney D Heinle
*Assistant Examiner* — Danielle M. Christensen
(74) *Attorney, Agent, or Firm* — Fletcher Yoder, P.C.

(57) ABSTRACT

A centrifugal compressor assembly is provided. The centrifugal compressor assembly includes a scroll assembly having a suction plate defining an inlet fluid passage, a suction plate housing, a diffuser plate, and a collector. The suction plate is detachably coupled to the suction plate housing, the suction plate housing is detachably coupled to the collector, and the diffuser plate is detachably coupled to the collector. The centrifugal compressor assembly further includes an impeller rotatably mounted in the scroll assembly for compressing fluid introduced through the inlet fluid passage, and a variable geometry diffuser system.

18 Claims, 11 Drawing Sheets

Related U.S. Application Data

(60) Provisional application No. 62/612,076, filed on Dec. 29, 2017, provisional application No. 62/562,666, filed on Sep. 25, 2017.

(51) Int. Cl.
*F04D 29/46* (2006.01)
*F04D 29/62* (2006.01)

(58) Field of Classification Search
CPC ..... F04D 29/40; F04D 29/403; F04D 29/406; F04D 29/4206; F04D 29/4213; F04D 29/462; F04D 29/624; F05D 2210/14
See application file for complete search history.

(56) References Cited

U.S. PATENT DOCUMENTS 3,149,478 A 9/1964 Anderson et al.
3,243,159 A * 3/1966 Hefler ..... F01D 17/165 415/150
3,489,340 A 1/1970 Holzhausen
3,635,580 A 1/1972 Richardson et al.
3,645,112 A 2/1972 Mount et al.
3,778,181 A 12/1973 Mcfarlin
3,992,128 A 11/1976 Lunsford et al.
4,182,137 A 1/1980 Erth
4,248,566 A * 2/1981 Chapman ..... F04D 27/0215 415/26
4,265,589 A * 5/1981 Watson ..... F04D 29/462 415/118
4,678,397 A 7/1987 Komatsu et al.
4,750,861 A 6/1988 Baker
4,802,820 A 2/1989 Komatsu
5,807,071 A 9/1998 Brasz et al.
6,032,472 A 3/2000 Heinrichs et al.
6,070,421 A 6/2000 Petrovich et al.
6,099,168 A 8/2000 Sishtla
6,237,353 B1 5/2001 Sishtla et al.
6,460,371 B2 10/2002 Kawada
6,506,031 B2 1/2003 Sishtla
6,547,520 B2 4/2003 Zinsmeyer et al.
6,638,007 B2 * 10/2003 Bartholoma ..... F01D 9/026 415/196
6,672,826 B2 1/2004 Leduc
6,872,050 B2 3/2005 Nenstiel
7,128,061 B2 10/2006 Middlebrook et al.
7,181,928 B2 2/2007 De Larminat
7,278,823 B2 10/2007 Platz
7,597,541 B2 10/2009 White
7,856,834 B2 12/2010 Haley
8,021,127 B2 9/2011 De Larminat
8,037,713 B2 10/2011 Haley et al.
8,156,757 B2 4/2012 Doty et al.
8,292,576 B2 10/2012 Frost et al.
8,393,856 B2 3/2013 Small et al.
8,397,534 B2 3/2013 Doty et al.
8,424,339 B2 4/2013 Sommer
8,434,323 B2 5/2013 Welch et al.
8,465,265 B2 6/2013 De Larminat
8,500,393 B2 8/2013 Cartwright et al.
8,511,981 B2 8/2013 Small et al.
8,516,850 B2 8/2013 Jadric et al.
8,602,728 B2 12/2013 Swiatek et al.
8,931,304 B2 1/2015 Beers et al.
8,959,950 B2 2/2015 Doty et al.
9,157,446 B2 10/2015 Brasz et al.
9,243,648 B2 1/2016 Clemons et al.
9,291,166 B2 3/2016 De Larminat et al.
9,291,167 B2 3/2016 Schreiber
9,353,765 B2 5/2016 Haley et al.
9,371,838 B2 6/2016 Small et al.
9,394,916 B2 7/2016 Small et al.
9,435,346 B2 9/2016 Osuka et al.
9,482,235 B2 11/2016 Small et al.
9,732,756 B2 8/2017 An et al.
2001/0022940 A1 9/2001 Funke
2003/0115870 A1 6/2003 Finger et al.
2006/0062666 A1 3/2006 Mcauliffe et al.
2007/0271956 A1 11/2007 Smith et al.
2009/0155058 A1 6/2009 Noelle
2009/0193839 A1 8/2009 Tsukamoto et al.
2010/0006265 A1 1/2010 De Larminat et al.
2010/0215485 A1 8/2010 Childe et al.
2012/0294711 A1 11/2012 Grigoriev et al.
2013/0302184 A1 11/2013 Sishtla
2014/0057103 A1 2/2014 Mozsgai et al.
2014/0186173 A1 7/2014 Blair et al.
2014/0356123 A1 12/2014 Gerber et al.
2014/0356140 A1 12/2014 Blair et al.
2014/0356145 A1 12/2014 Gerber et al.
2014/0356147 A1 12/2014 Gerber et al.
2015/0063994 A1 3/2015 Cho et al.
2015/0114364 A1 * 4/2015 Matsuda ..... F02B 61/02 123/559.1
2016/0053760 A1 2/2016 Theelen et al.
2016/0123346 A1 5/2016 Isogai et al.
2016/0177965 A1 6/2016 Svihla et al.

FOREIGN PATENT DOCUMENTS

CN 1745253 A 3/2006
CN 101421519 A 4/2009
CN 101514705 A 8/2009
CN 104854351 A 8/2015
CN 104884814 A 9/2015
CN 105683582 A 6/2016
CN 105051466 B 9/2017
CN 107980082 A 5/2018
EP 1 119 732 A1 8/2001
JP S63130698 U 2/1987
JP H11132197 A 5/1999
TW 536610 B 6/2003
WO WO-2013/039572 A1 3/2013
WO WO-2014/039155 A2 3/2014
WO WO-2014/084989 A2 6/2014
WO WO-2014/089551 A1 6/2014
WO WO-2014/117015 A1 7/2014
WO WO-2014/200476 A1 12/2014
WO WO-2015/053939 A1 4/2015
WO 2016092897 A1 6/2016

OTHER PUBLICATIONS

European Office Action for EP Application No. 18786514.2, dated May 11, 2022, 9 pgs.
Chinese Office Action for CN Application No. 201880075414.7, dated Feb. 8, 2022, 11 pgs.
Chinese Office Action for CN Application No. 201880075414.7 dated Nov. 26, 2020, 10 pgs.
Chinese Office Action for CN Application No. 201880075414.7 dated Jul. 20, 2021, 12 pgs.
Carrier. Product Data AquaEdge High-Efficiency Semi-Hermetic Centrifugal Liquid Chillers 500 to 800 Nominal Tons (1758 to 2814 Nominal kW), Jul. 1, 2018. 28 pages.
International Search Report and Written Opinion for International Application No. PCT/US2018/052259 dated Apr. 1, 2019, 17 pages.
Office Action on Taiwanese patent application No. 107133507 dated Mar. 29, 2019.
Search Report on Taiwanese patent application No. 107133507 dated Mar. 29, 2019. 1 page.
Korean Office Action for KR Application No. 10-2020-7011873, dated Jan. 29, 2024, 4 pages.
European Office Action for EP Application No. 18786514.2, dated Mar. 11, 2024, 5 pages.

* cited by examiner

TWO PIECE SPLIT SCROLL FOR CENTRIFUGAL COMPRESSOR

CROSS-REFERENCE TO RELATED PATENT APPLICATIONS

This application is a continuation of U.S. application Ser. No. 16/649,863, entitled "TWO PIECE SPLIT SCROLL FOR CENTRIFUGAL COMPRESSOR", filed Mar. 23, 2020, which is a 371 of International Application No. PCT/US2018/052259, filed Sep. 21, 2018, which claims the benefit of U.S. Provisional Application No. 62/562,666, filed Sep. 25, 2017, and U.S. Provisional Application No. 62/612,076, filed Dec. 29, 2017. The entire disclosure of each application is incorporated by reference herein.

BACKGROUND

Buildings can include heating, ventilation and air conditioning (HVAC) systems.

SUMMARY

One implementation of the present disclosure is a centrifugal compressor assembly. The centrifugal compressor assembly includes a scroll assembly having a suction plate defining an inlet fluid passage, a suction plate housing, a diffuser plate, and a collector. The suction plate is detachably coupled to the suction plate housing, the suction plate housing is detachably coupled to the collector, and the diffuser plate is detachably coupled to the collector. The centrifugal compressor assembly further includes an impeller rotatably mounted in the scroll assembly for compressing fluid introduced through the inlet fluid passage, and a variable geometry diffuser system.

The suction plate can include a suction base plate with an outer suction flange, a first suction annular portion extending in a first axial direction from the suction base plate, and a second suction annular portion extending in a second axial direction from the suction base plate. The suction plate housing can include a housing base plate with an outer housing flange, and a first housing annular portion extending in the first axial direction from the housing base plate. The outer suction flange of the suction plate can be coupled to the first housing annular portion of the suction plate housing using multiple fasteners. The collector can include a first axial flange, a body portion defining a discharge fluid path for a flow of fluid exiting the impeller, and a second axial flange. The outer housing flange of the suction plate housing can be coupled to the first axial flange of the collector using multiple fasteners.

The variable geometry diffuser system can include a drive ring rotatable by an actuator between a first position and a second position, and a diffuser ring coupled to the drive ring using a drive pin. The drive ring moves the diffuser ring between a retracted position and an extended position. The extended position causes a flow of fluid exiting the impeller to be substantially blocked from flowing through a diffuser gap downstream of the impeller. At least one of the suction plate, the suction plate housing, the diffuser plate, and the collector can be formed using a casting process. The fluid to be compressed can be a refrigerant. The refrigerant can be R1233zd.

Another implementation of the present disclosure is a centrifugal compressor assembly. The centrifugal compressor assembly includes a scroll assembly having a first scroll component and a second scroll component. The first scroll component includes an outer flange and an annular portion extending in a first axial direction that defines an inlet fluid passage. The second scroll component includes an axial flange and a body portion that defines a discharge fluid passage. The outer flange of the first scroll component can be coupled to the axial flange of the second scroll component using multiple fasteners. The centrifugal compressor assembly further includes an impeller rotatably mounted in the scroll assembly for compressing fluid introduced through the inlet fluid passage.

The fluid to be compressed can be a refrigerant. The fasteners coupling the first scroll component to the second scroll component can be located outside the inlet fluid passage of the fluid. At least one of the first scroll component and the second scroll component can be formed using a casting process. The first scroll component can be coupled to multiple inlet vanes located upstream of the impeller.

Yet another implementation of the present disclosure is a centrifugal compressor assembly. The centrifugal compressor assembly includes a scroll assembly having a first scroll component and a second scroll component. The second scroll component has a substantially plate-like geometry. The second scroll component can be detachably coupled to first scroll component using multiple fasteners. The centrifugal compressor assembly further includes an impeller rotatably mounted in the scroll assembly for compressing fluid introduced through the inlet fluid passage, and a diffuser system.

The fasteners coupling the first scroll component to the second scroll component can be located outside the inlet fluid passage of the fluid. Removal of the second scroll component can permit a user to access a component of the diffuser system. The scroll assembly can include a flow straightener coupled to the second scroll component and having multiple vanes. At least one of the first scroll component and the second scroll component can be formed using a casting process.

DETAILED DESCRIPTION

Referring generally to the FIGURES, a chiller assembly having a centrifugal compressor with a two piece split scroll or collector is shown. Centrifugal compressors are useful in a variety of devices that require a fluid to be compressed, such as chillers. In order to effect this compression, centrifugal compressors utilize rotating components in order to convert angular momentum to static pressure rise in the fluid.

A centrifugal compressor can include four main components: an inlet, an impeller, a diffuser, and a collector or volute. The inlet can include a simple pipe that draws fluid (e.g., a refrigerant) into the compressor and delivers the fluid to the impeller. In some instances, the inlet may include inlet guide vanes that ensure an axial flow of fluid to the impeller inlet. The impeller is a rotating set of vanes that gradually raises the energy of the fluid as it travels from the center of the impeller (also known as the eye of the impeller) to the outer circumferential edges of the impeller (also known as the tip of the impeller). Downstream of the impeller in the fluid path is the diffuser mechanism, which acts to decelerate the fluid and thus convert the kinetic energy of the fluid into static pressure energy. Upon exiting the diffuser, the fluid enters the collector or volute, where further conversion of kinetic energy into static pressure occurs due to the shape of the collector or volute.

The scroll or outer housing of a centrifugal compressor can be fabricated as a single component. However, this may result in a large component that is difficult and expensive to fabricate, e.g., using a casting process. In addition to the substantial size, weight, and cost of the part, a unitary design for the scroll can make assembling and servicing the compressor difficult, since the entire scroll may need to undergo an alignment process during installation. During servicing activities, the entire scroll may need to be removed in order to access the impeller and/or diffuser. A compressor scroll design that negates or minimizes these issues can be useful.

Figure 1:
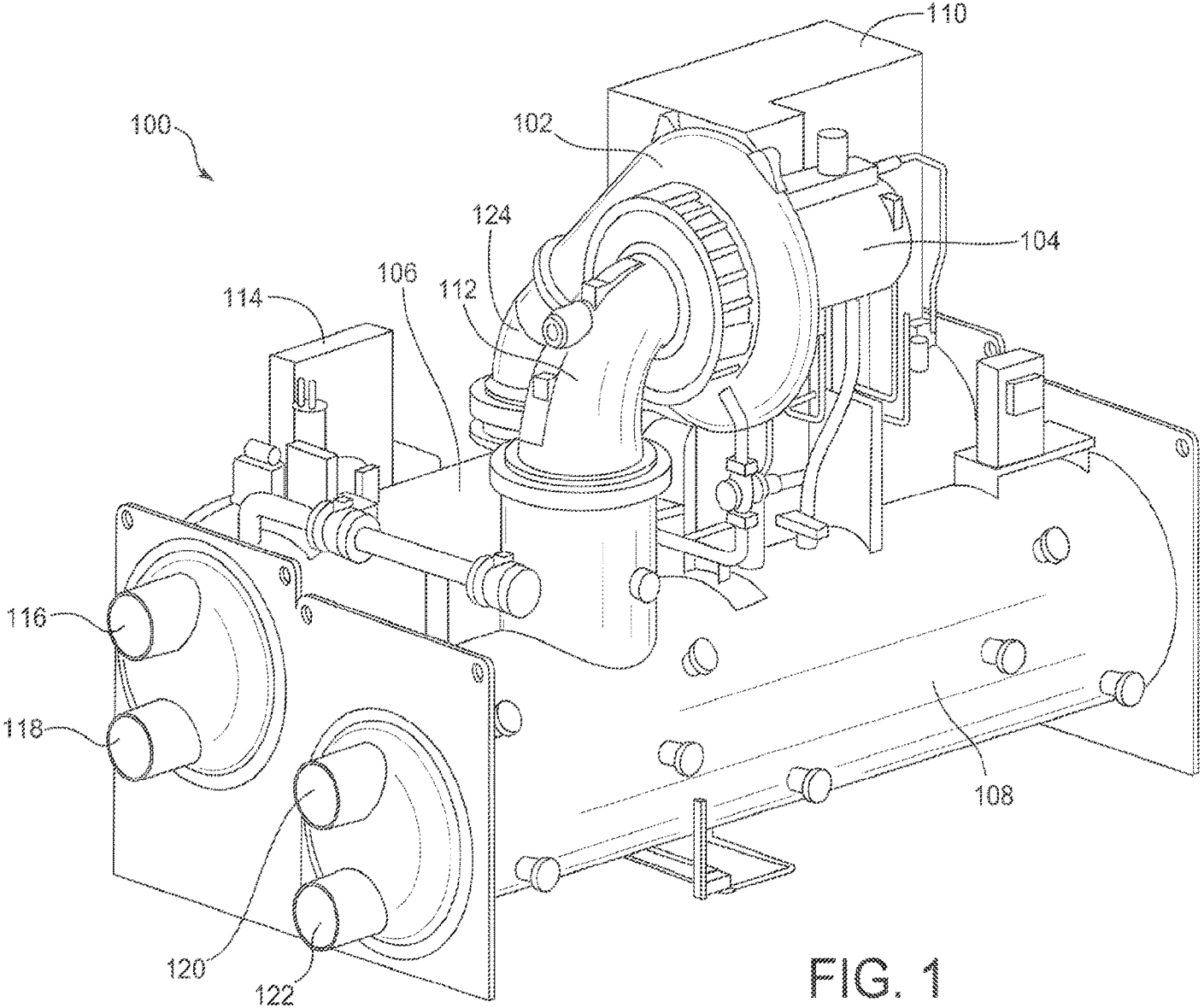
FIG. 1 is a perspective view drawing of a chiller assembly, according to some embodiments.
Figure 2:
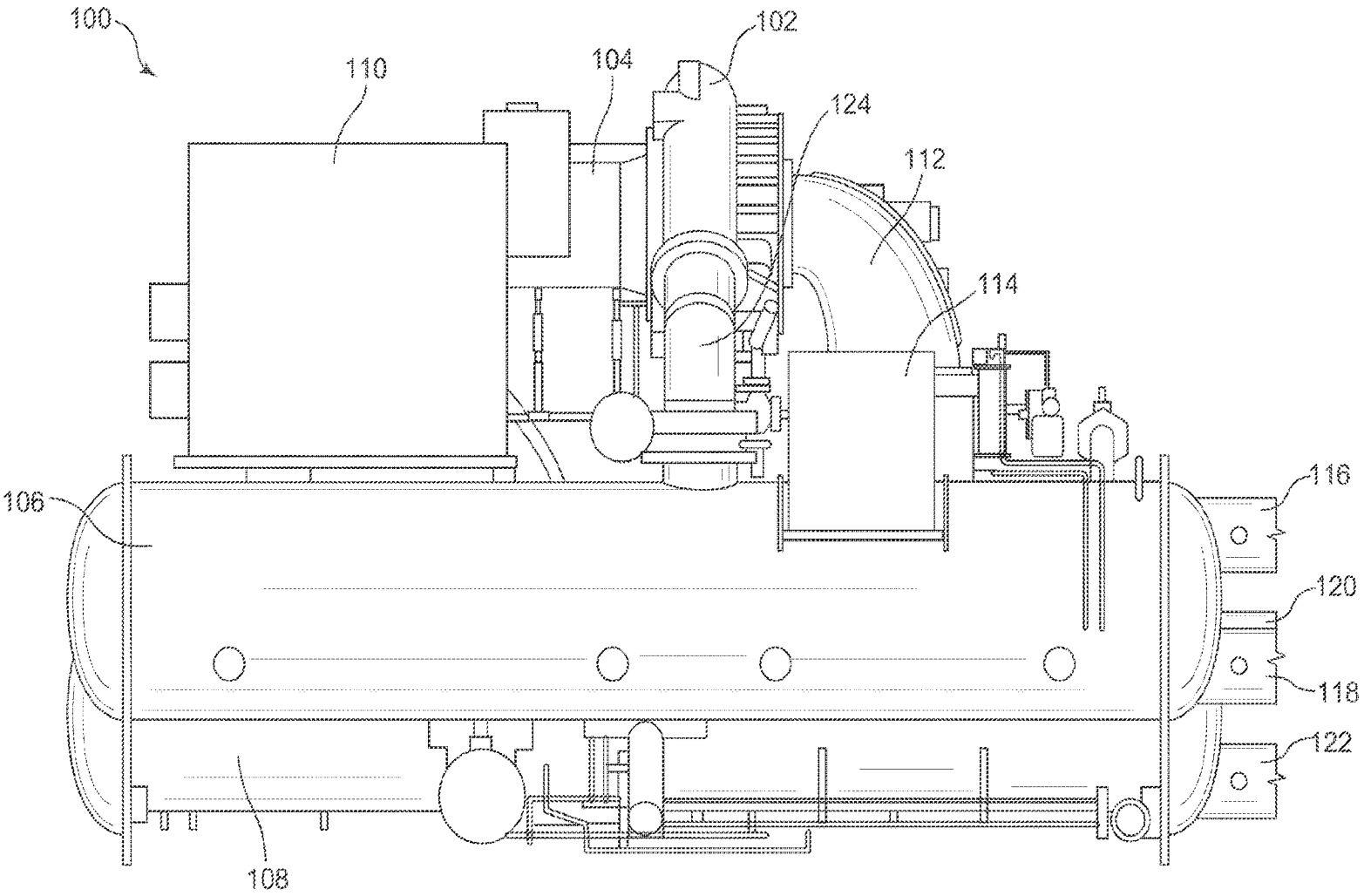
FIG. 2 is an elevation view drawing of the chiller assembly of FIG. 1, according to some embodiments.

Referring now to FIGS. 1-2, an example implementation of a chiller assembly 100 is depicted. Chiller assembly 100 is shown to include a compressor 102 driven by a motor 104, a condenser 106, and an evaporator 108. A refrigerant is circulated through chiller assembly 100 in a vapor compression cycle. Chiller assembly 100 can also include a control panel 114 to control operation of the vapor compression cycle within chiller assembly 100.

Motor 104 can be powered by a variable speed drive (VSD) 110. VSD 110 receives alternating current (AC) power having a particular fixed line voltage and fixed line frequency from an AC power source (not shown) and provides power having a variable voltage and frequency to motor 104. Motor 104 can be any type of electric motor than can be powered by a VSD 110. For example, motor 104 can be a high speed induction motor. Compressor 102 is driven by motor 104 to compress a refrigerant vapor from evaporator 108 through suction line 112 and to deliver refrigerant vapor to condenser 106 through a discharge line 124. Compressor 102 can be a centrifugal compressor, a screw compressor, a scroll compressor, a turbine compressor, or any other type of suitable compressor. In the implementations depicted in the FIGURES, compressor 102 is a centrifugal compressor.

Evaporator 108 includes an internal tube bundle (not shown), a supply line 120 and a return line 122 for supplying and removing a process fluid to the internal tube bundle. The supply line 120 and the return line 122 can be in fluid communication with a component within a HVAC system (e.g., an air handler) via conduits that circulate the process fluid. The process fluid is a chilled liquid for cooling a building and can be, but is not limited to, water, ethylene glycol, calcium chloride brine, sodium chloride brine, or any other suitable liquid. Evaporator 108 is configured to lower the temperature of the process fluid as the process fluid passes through the tube bundle of evaporator 108 and exchanges heat with the refrigerant. Refrigerant vapor is formed in evaporator 108 by the refrigerant liquid delivered to the evaporator 108 exchanging heat with the process fluid and undergoing a phase change to refrigerant vapor.

Refrigerant vapor delivered by compressor 102 to condenser 106 transfers heat to a fluid. Refrigerant vapor condenses to refrigerant liquid in condenser 106 as a result of heat transfer with the fluid. The refrigerant liquid from condenser 106 flows through an expansion device and is returned to evaporator 108 to complete the refrigerant cycle of the chiller assembly 100. Condenser 106 includes a supply line 116 and a return line 118 for circulating fluid between the condenser 106 and an external component of the HVAC system (e.g., a cooling tower). Fluid supplied to the condenser 106 via return line 118 exchanges heat with the refrigerant in the condenser 106 and is removed from the condenser 106 via supply line 116 to complete the cycle. The fluid circulating through the condenser 106 can be water or any other suitable liquid.

The refrigerant can have an operating pressure of less than 400 kPa or approximately 58 psi, for example. In some embodiments, the refrigerant is R1233zd. R1233zd is a non-flammable fluorinated gas with low Global Warming Potential (GWP) relative to other refrigerants utilized in commercial chiller assemblies. GWP is a metric developed to allow comparisons of the global warming impacts of different gases, by quantifying how much energy the emissions of 1 ton of a gas will absorb over a given period of time, relative to the emissions of 1 ton of carbon dioxide.

Figure 3:
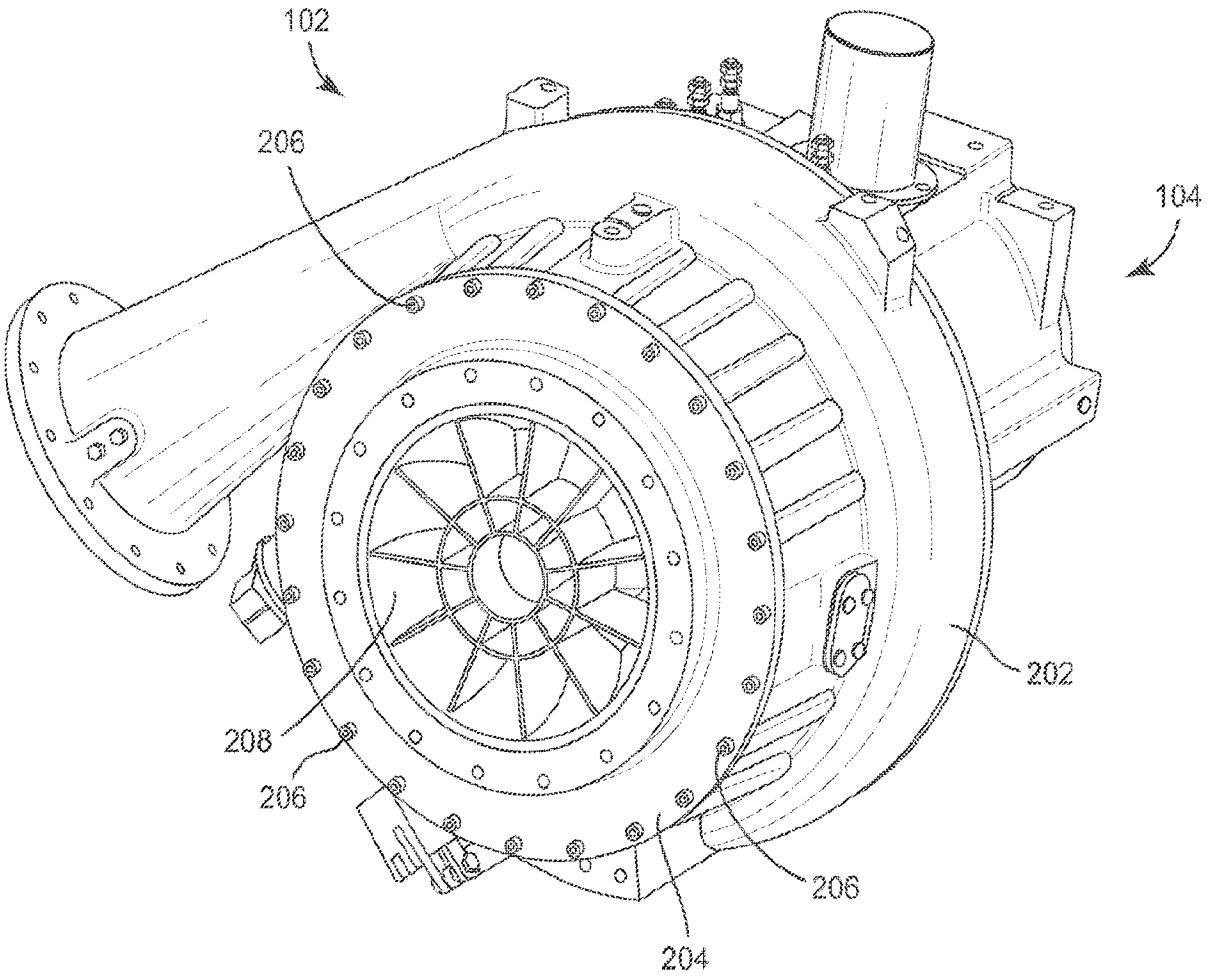
FIG. 3 is a perspective view drawing of a two piece split scroll assembly for a centrifugal compressor, according to some embodiments.

Referring now to FIG. 3, a two piece split scroll assembly for a centrifugal compressor is depicted, according to some embodiments. The compressor 102 can be coupled to and driven by motor 104. Compressor 102 is shown to include a scroll or collector portion comprising a first scroll component 202 and a second scroll component 204. The first scroll component 202 and the second scroll component are configured to be cast as separate parts using a cheaper and easier "green sand" casting process, as opposed to the highly cored casting process required by a unitary scroll design. Collectively, the first scroll component 202 and the second scroll component 204 are configured to house, among other components, an impeller and a variable geometry diffuser (VGD) system described in greater detail with reference to FIGS. 4 and 7 below. In some embodiments, the first scroll component 202 may be known as a suction plate housing.

Second scroll component 204 has a substantially plate-like geometry and is coupled to the first scroll component via fasteners 206. In some embodiments, the second scroll component 204 may be referred to as a suction plate. Fasteners 206 may be any suitable type of fastener (e.g., bolts, screws, pins) that may be utilized to detachably couple the first scroll component 202 to the second scroll component 204. In various embodiments, the two piece split scroll may include any number of fasteners 206, in any pattern required to suitably couple the first scroll component 202 to the second scroll component 204. Significantly, fasteners 206 are oriented such that they are outside of and consequently do not impede a flow path of refrigerant fluid as it passes through the compressor 102, avoiding any potential degradation to the performance of the compressor 102. By contrast, flow paths impeded by fasteners may experience flow irregularities including eddy currents and boundary layer separation which may result in pressure losses in the compressor 102. Pressure losses may cause unsteady flow or even stall conditions, which may significantly reduce the efficiency of compressor 102.

The second scroll component 204 can be coupled to a flow straightener 208. The flow straightener 208 can be a component having a plurality of vanes. The plurality of vanes can be mounted upstream of the impeller to ensure the axial flow of fluid at an impeller inlet, thereby increasing the performance of the compressor 102.

Figure 4:
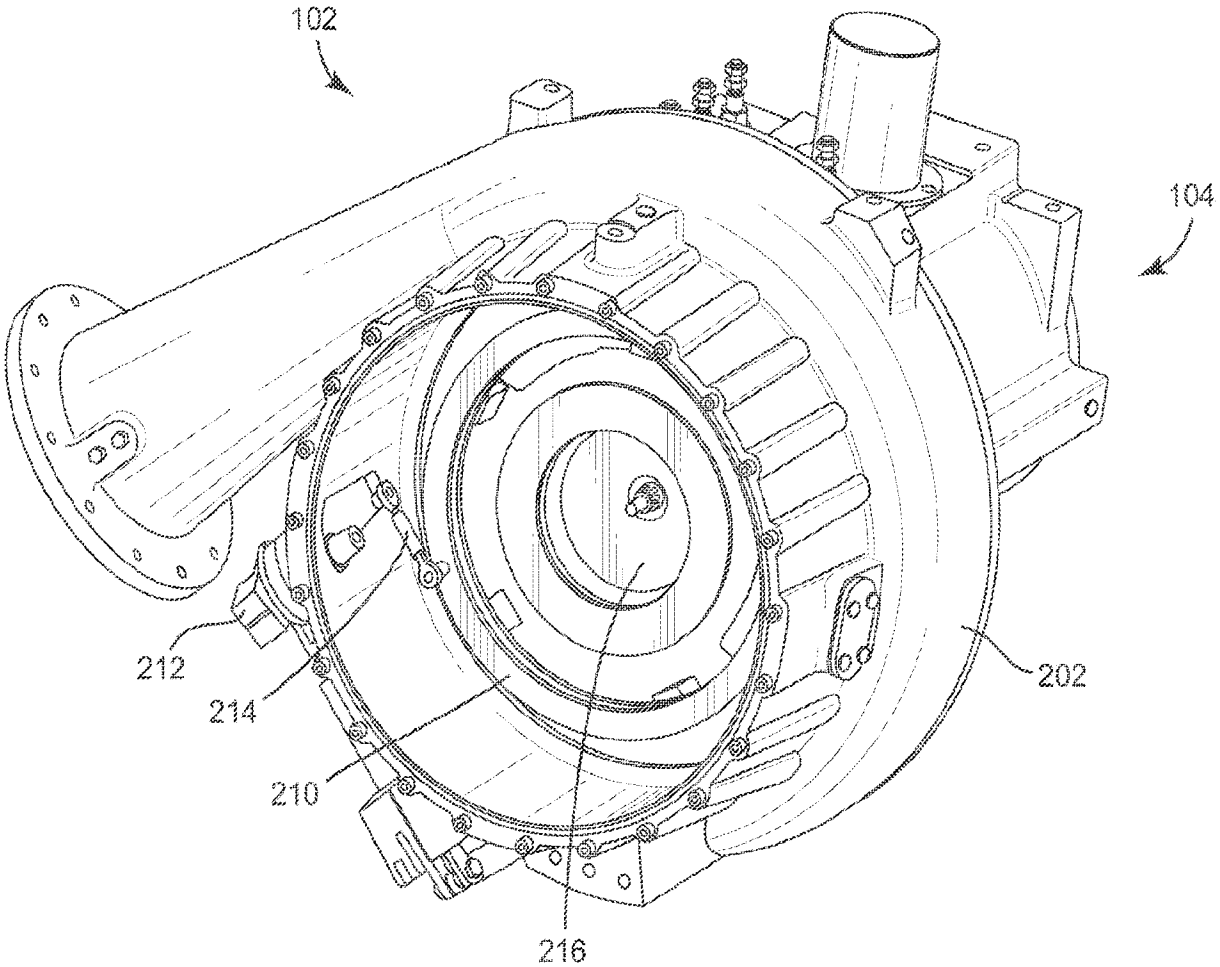
FIG. 4 is a perspective view drawing of the two piece split scroll assembly with the front cover portion of the scroll assembly removed, according to some embodiments.

Turning now to FIG. 4, a view of the two piece split scroll assembly of FIG. 3 is depicted with the second scroll component 204 removed. The first scroll component 202 can house various components of the compressor 102, including a variable geometry diffuser (VGD) system having a drive ring 210. The VGD system is configured to stabilize a flow of fluid exiting an impeller 216, and may include, in addition to the drive ring 210, an actuating mechanism or actuator 212 coupled to the drive ring 210 via linkage 214, as well as a diffuser ring (not shown) coupled to the drive ring 210. The actuating mechanism 212 can move the drive ring 210 between a first position and a second position via the linkage 214. Movement of the drive ring 210 subsequently causes the diffuser ring to travel between a retracted position in which the flow of fluid through a diffuser gap located downstream of the impeller exit is substantially unimpeded, and an extended position in which the flow of fluid through the diffuser gap is substantially or wholly blocked.

The two piece design of the scroll assembly affords several advantages over the unitary scroll design. Without a two piece scroll, a compressor assembly technician may be required to couple the linkage 212 to the actuating mechanism via a small access hole located in the unitary scroll, resulting in a difficult and time-consuming assembly process. By contrast, since fastening of the second scroll component 204 to the first scroll component 202 can comprise the last step in the compressor assembly process, easy access to all components of the VGD system is provided during installation. Because the second scroll component 204 can be removed upon indication of failure of the impeller, the impeller can be replaced or repaired prior to causing damage to the scroll assembly that may result in scrap of the entire scroll assembly. Likewise, both the impeller and the VGD system can be serviced or repaired without requiring removal of the motor 104. In addition, the exposed gas flow passages of the two piece scroll design result in several manufacturing advantages. For example, a foundry casting the first scroll component 202 and the second scroll component 204 is able to use manufacturing techniques that result in superior (e.g., smoother) surface finishes within the gas flow passages. Smoother surface finishes can result in superior compressor aerodynamic performance, thereby increasing the efficiency of the compressor.

Although the scroll assembly detailed above has been described with reference to a two piece design, other scroll assembly designs including three or more scroll components are also within the scope of the present disclosure. For example, first scroll component 202 may be most easily fabricated as two or more discrete parts that are either permanently affixed or detachably coupled to one another.

Figure 5:
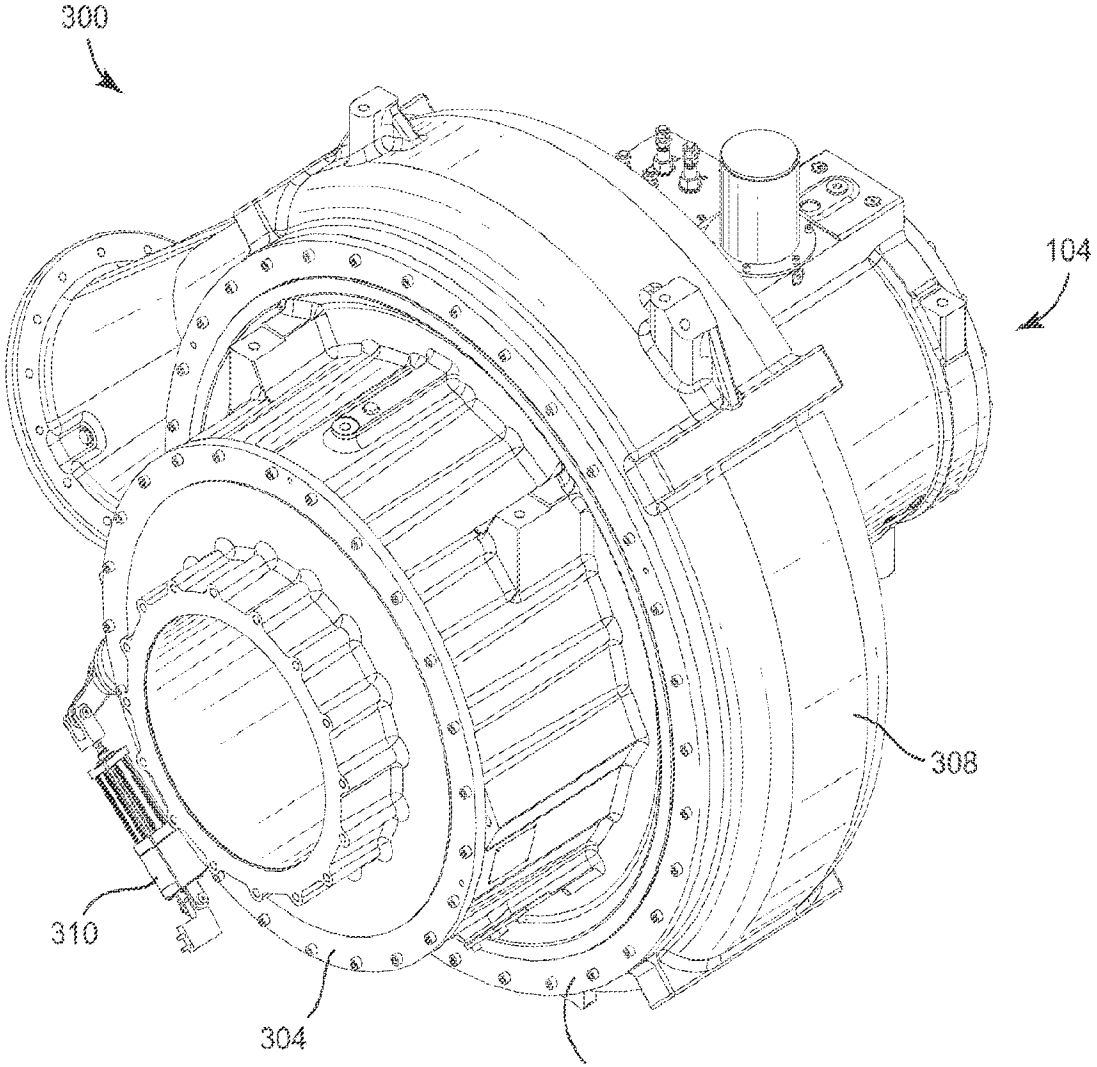
FIG. 5 is a perspective view drawing of a multicomponent scroll assembly, according to some embodiments.

An implementation of a multicomponent scroll is depicted in the perspective view of FIG. 5. Multicomponent scroll assembly 300 may include, among other components, a suction plate housing 302, a suction plate 304, and a collector 308, each of which can be fabricated as a separate component. The separate components 302, 304, and 308 may then be permanently or detachably coupled to each other. In some embodiments, suction plate housing 302 is identical or substantially similar to first scroll component 202, and suction plate 304 is identical or substantially similar to second scroll component 204, described above with reference to FIGS. 3-4. An actuating mechanism or actuator 310 may be mounted proximate the exterior surfaces of the suction plate housing 302 and the suction 304. The actuating mechanism 310 may be coupled to the drive ring of a diffuser system housed within the multicomponent scroll assembly 300.

Figure 6:
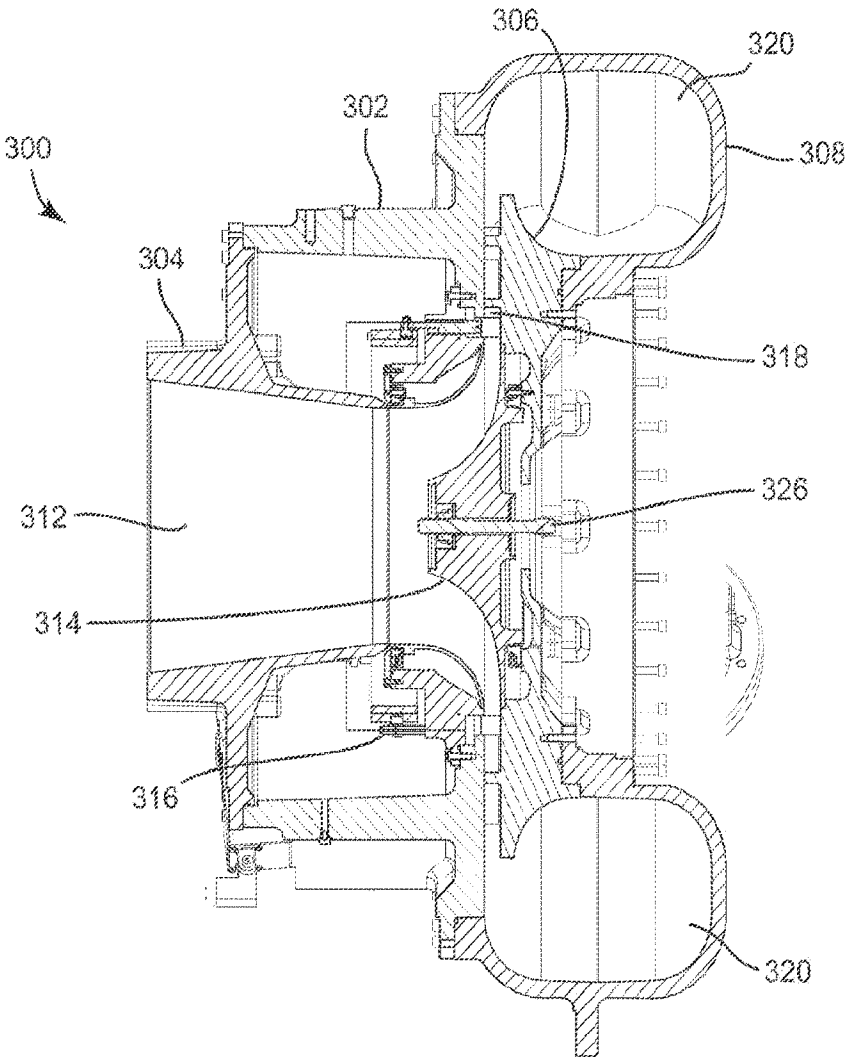
FIG. 6 is a sectional view drawing of the multicomponent scroll assembly of FIG. 5, according to some embodiments.
Figure 7:
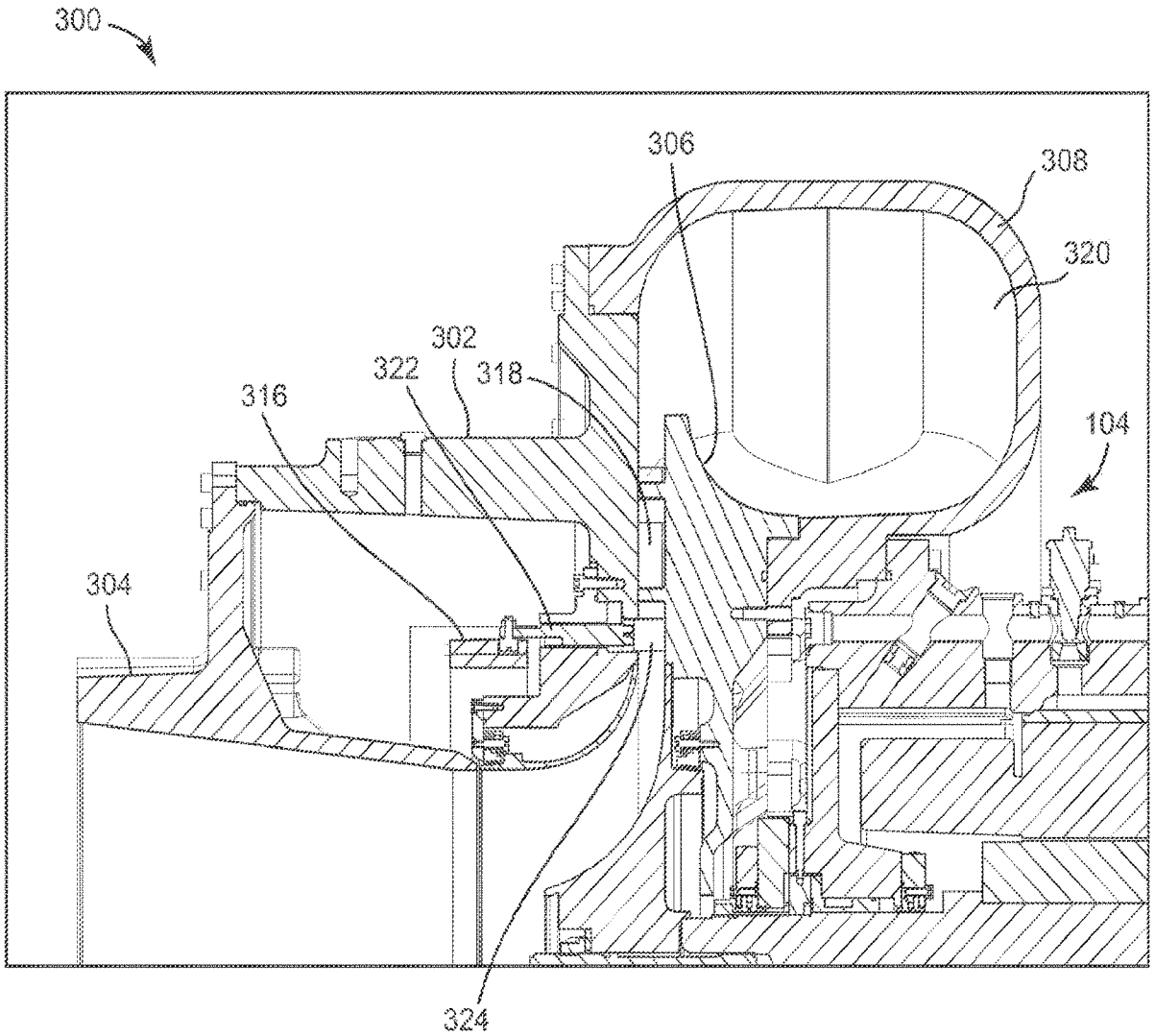
FIG. 7 is a detail sectional view drawing of the multicomponent the scroll assembly of FIG. 6, according to some embodiments.

Referring specifically to FIGS. 6-7, sectional views of the multicomponent split scroll assembly 300 are depicted, according to some embodiments. The path of refrigerant through the multicomponent split scroll assembly 300 may be as follows: refrigerant may enter the assembly through a central inlet passage 312 formed by the suction plate 304 that delivers fluid to an impeller 314. In some embodiments, the central inlet passage 312 may gradually decrease in diameter to direct the flow of fluid to the center of the impeller 314. The impeller 314 may include a rotating set of vanes that gradually raise the energy of the fluid as it travels from the center to the outer circumferential edges of the impeller 314. In some embodiments, the impeller 314 is directly driven by the motor 104 using drive connection member 326. Downstream of the impeller 314 in the fluid path is the diffuser gap 318. The diffuser gap 318 may be formed, at least in part, by surfaces of the suction plate housing 302 and a diffuser plate 306.

The size of the diffuser gap 318 may vary based on the position of the diffuser ring 324. Diffuser ring 324 may travel between a fully retracted position in which flow through the diffuser gap 318 is unimpeded, and a fully extended position in which flow through the diffuser gap 318 is substantially or fully blocked. The position of the diffuser ring 324 may be modified via rotation of a drive ring 316 and corresponding movement of a drive pin 322 used to couple the diffuser ring 324 to the drive ring 316. Rotation of drive ring 316 may be accomplished by an actuator (e.g., actuator 310). By varying the geometry of the diffuser at the impeller exit, undesirable effects of rotating stall, incipient surge, and surge may be minimized.

After traveling past the diffuser gap 318, the fluid may enter a collector passage 320 of the collector 308. Collector 308 may be known as a folded or rolled back collector because the collector passage 320 extends in a substantially orthogonal direction to the fluid path of the fluid exiting the impeller 314. Although a folded collector passage reduces the overall size of the compressor 102 and may therefore enable easier shipping of the chiller assembly, a single-piece folded collector may require complicated manufacturing processes and may also be less accessible for cleaning. These disadvantages may be minimized by a multicomponent scroll that readily exposes the flow path area for purposes of cleaning after manufacturing. Additionally, the exposed flow path area allows for manufacturing methods which produce smoother flow path surface finishes, resulting in higher efficiency of the compressor. A multicomponent folded collector is advantageous for its capability to be partially disassembled for field servicing and cleaning. The collector passage 320 may extend a full or a substantially full 360° about the impeller 314 and may act to collect and direct the fluid exiting the diffuser gap 318 to a discharge outlet of the compressor 102. In some embodiments, the collector passage 320 may have a non-uniform cross-section as the fluid travels along the full length of the collector passage 320. When the collector passage 320 has a non-uniform cross-sectional area, the passage may be referred to as a volute, rather than a collector.

Figure 8:
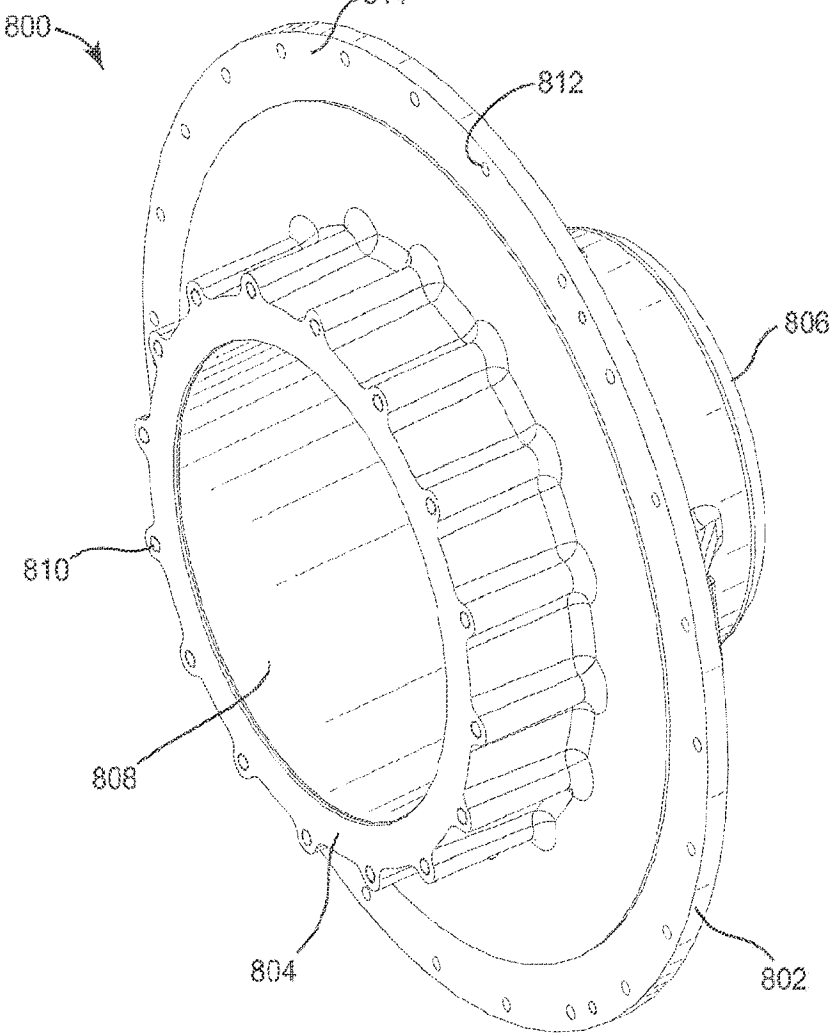
FIG. 8 is a perspective view drawing of a suction plate used in the multicomponent scroll assembly of FIG. 5, according to some embodiments.

Turning now to FIG. 8, a perspective view of a suction plate 800 that may be utilized in a multicomponent scroll is depicted. In various embodiments, suction plate 800 may be identical or substantially similar to suction plate 304, described above with reference to FIGS. 5-7. Suction plate 800 may include a base plate 802 with an outer flange 814. A first annular portion 804 extends from the base plate 802 in a first axial direction (i.e., toward the suction inlet of the compressor 102), and a second annular portion 806 extending from the base plate 802 in a second and opposite axial direction. Collectively, the base plate 802, the first annular portion 804, and the second annular portion 806 define a central inlet passage 808 that guides a flow of refrigerant into the compressor 102 and towards an impeller.

The first annular portion 804 may include multiple holes 810 located radially outward of the central fluid passage 808. In the implementation depicted in FIG. 8, the holes 810 are blind threaded holes configured to receive threaded fasteners. The threaded fasteners may be threaded into the holes 810 in order to couple a suction inlet (e.g., suction inlet 112, described above with reference to FIGS. 1-2) to the first annular portion 804. In some embodiments, a flow straightener (e.g., flow straightener 208, described above with reference to FIG. 3) may be coupled to the first annular portion 804.

The base plate 802 is further shown to include multiple holes 812 distributed about the outer flange 814. In the implementation depicted in FIG. 8, the holes 812 are through holes. Fasteners (e.g., bolts, screws) may be inserted through the holes 812 and secured into threaded holes located on another component. In some embodiments, the threaded holes may be a feature of suction plate housing 900 (i.e., holes 908, described in further detail below). The orientation and position of holes 810 and 812 may locate fasteners used to couple the components of the multicomponent scroll parallel to the inlet fluid path through the central inlet passage 808 and outside of the fluid path, reducing the possibility of flow irregularities leading to performance degradation. Suction plate 800 may include any number and pattern of holes 810 and 812 required to couple the components of the multicomponent scroll.

Figure 9:
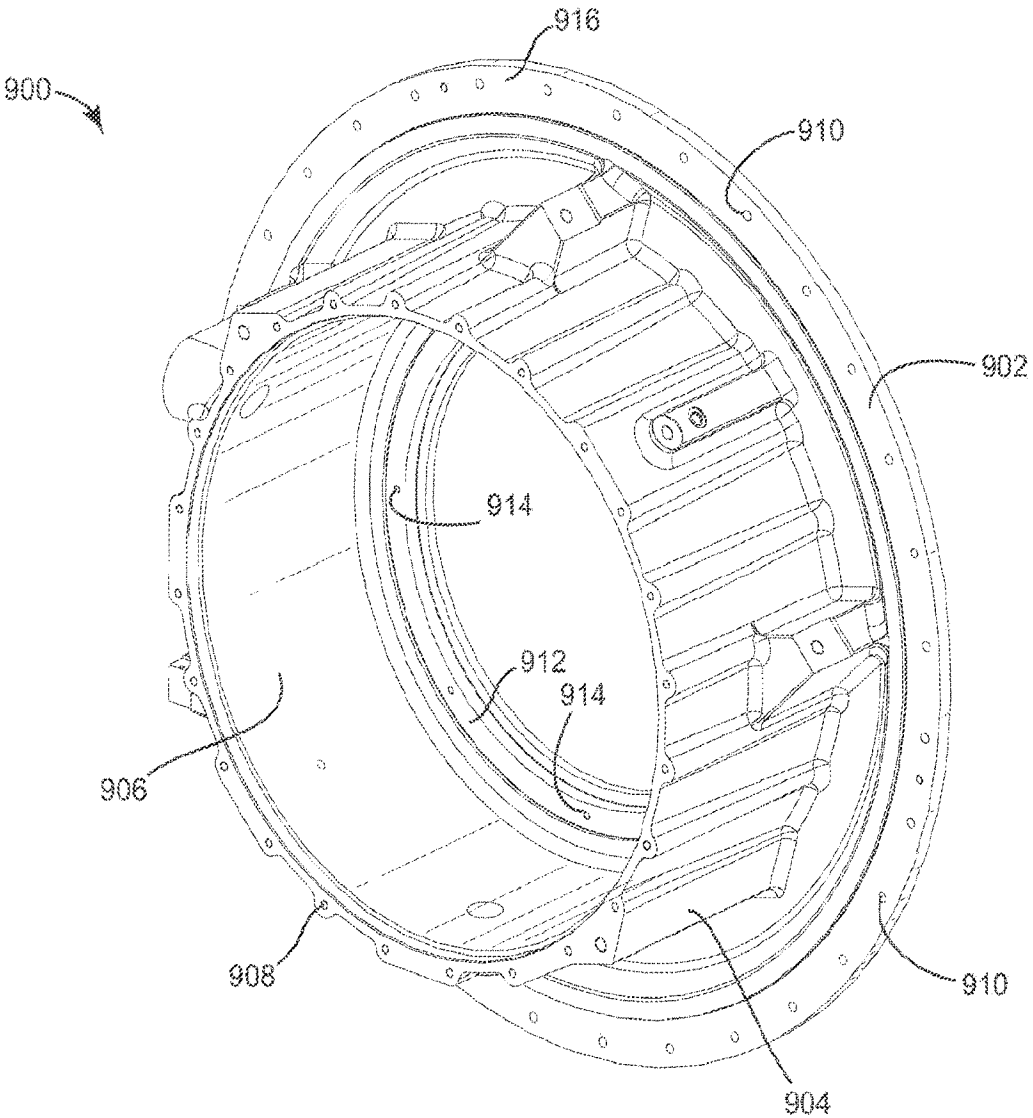
FIG. 9 is a perspective view drawing of a suction plate housing used in the multicomponent scroll assembly of FIG. 5, according to some embodiments.

Referring now to FIG. 9, a perspective view of a suction plate housing 900 that may be utilized in a multicomponent scroll is depicted. In various embodiments, suction plate housing 900 may be identical or substantially similar to suction plate housing 302, described above with reference to FIGS. 5-7. Suction plate housing 900 may include a base plate 902 with an outer flange 916 and an inner flange 912. A first annular portion 904 extends from the base plate 902 in a first axial direction. The base plate 902 and the first annular portion 904 may define a central volume region 906. When the multicomponent split scroll assembly is in a fully assembled state, the central volume region 906 may house both a portion of the suction plate (e.g., second annular portion 806, described above with reference to FIG. 8) and components of the VGD (e.g., drive ring 316, described above with reference to FIGS. 6-7).

The first annular portion 904 is shown to include multiple holes 908 located radially outward of the central volume region 906. In the implementation depicted in FIG. 9, the holes 908 are blind threaded holes configured to receive threaded fasteners. The threaded fasteners may be threaded into the holes 908 in order to couple a suction plate (e.g., suction plate 800) to the first annular portion 904.

The base plate 902 is similarly shown to include multiple holes 910 distributed about the outer flange 916 and multiple holes 914 distributed about the inner flange 912. In the implementation depicted in FIG. 9, the holes 910 are through holes, while the holes 914 are threaded holes. Fasteners (e.g., bolts, screws) may be inserted through the holes 910 and secured into threaded holes located on another component. In some embodiments, the threaded holes may be a feature of collector 1100 (i.e., holes 1110, described in further detail below). Holes 914 may be utilized may be utilized to couple components of the VGD to the suction plate housing 900. Suction plate housing 900 may include any number and pattern of holes 908, 910, and 914 required to couple the components of the multicomponent scroll.

Figure 10:
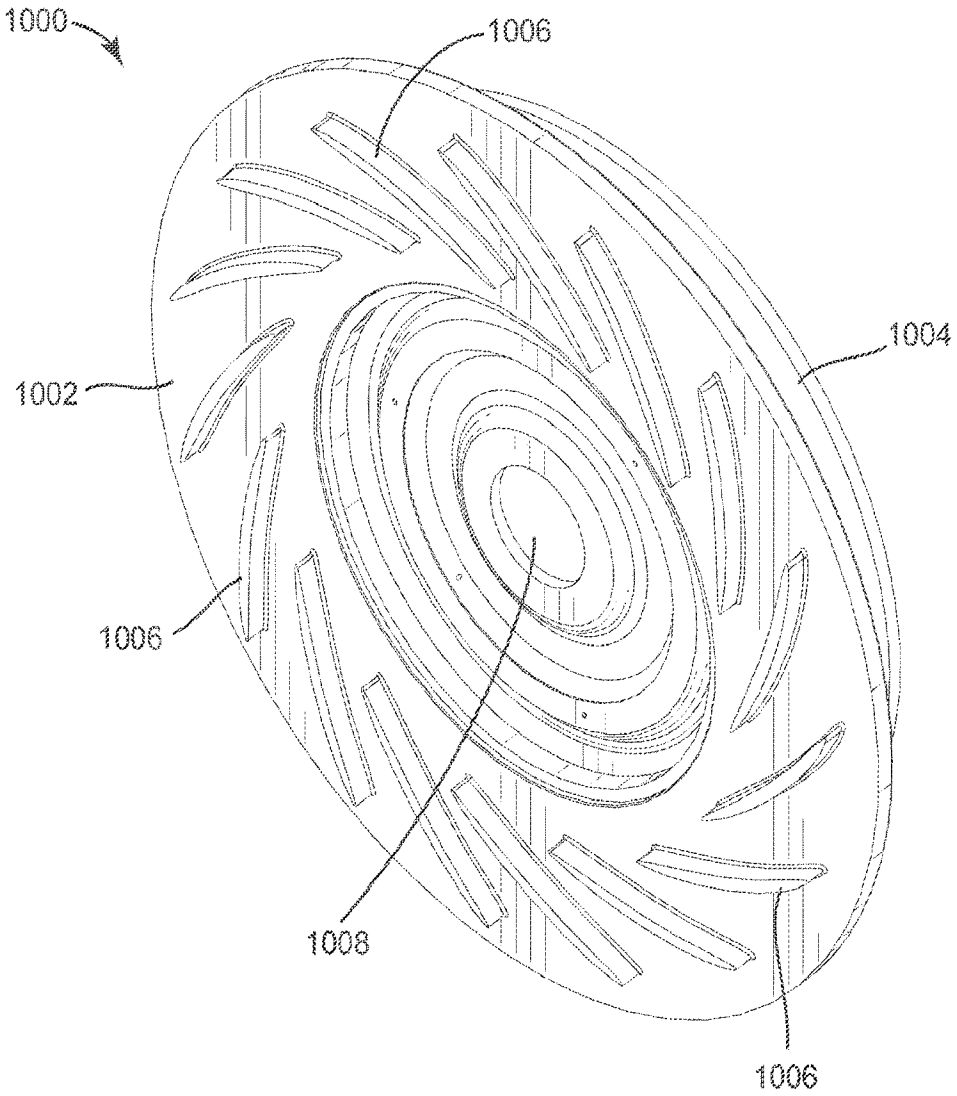
FIG. 10 is a perspective view drawing of a diffuser plate used in the multicomponent scroll assembly of FIG. 5, according to some embodiments.

Referring now to FIG. 10, a perspective view of a diffuser plate 1000 that may be utilized in a multicomponent scroll is depicted. In various embodiments, diffuser plate 1000 may be identical or substantially similar to diffuser plate 306, described above with reference to FIGS. 5-7. Diffuser plate 1000 is shown to include a base plate 1002 and a first annular portion 1004. In various embodiments, first annular portion 1004 includes multiple holes (not shown) that may be utilized to couple a collector (e.g., collector 1100) to the first annular portion 1004.

In some embodiments, diffuser vanes 1006 are stationary relative to base plate 1002. In other embodiments, an actuating mechanism may be utilized to rotate the orientation of the diffuser vanes 1006 relative to the base plate 1002. Diffuser vanes 1006 may act to convert the kinetic energy of the high velocity fluid into static pressure before the compressed refrigerant fluid exits the compressor 102 via the collector. Diffuser vanes 1006 may be arranged about a central passage 1008. Central passage 1008 may enable a mechanical connection (e.g., drive connection member 326) between the motor and the impeller.

Figure 11:
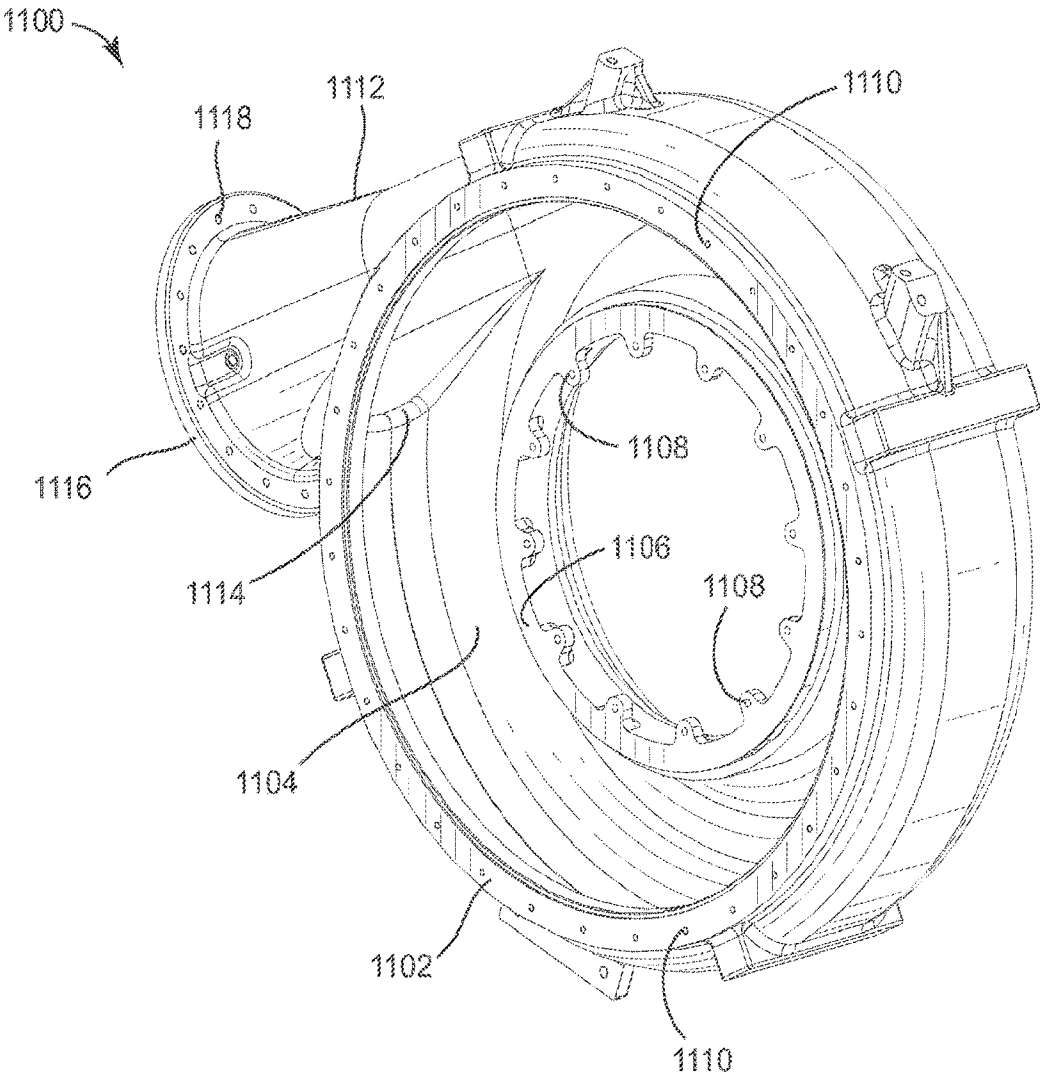
FIG. 11 is a perspective view drawing of a collector used in the multicomponent scroll assembly of FIG. 5, according to some embodiments.

Turning now to FIG. 11, a perspective view of a collector 1100 that may be utilized in a multicomponent scroll is depicted. In various embodiments, collector 1100 may be identical or substantially similar to collector 308, described above with reference to FIGS. 5-7. Collector 1100 is shown to include a first axial flange 1102, a body portion 1104, and a second axial flange 1106.

Body portion 1104 defines a collector path that defines a full or a substantially full 360° fluid path to a discharge portion 1112. In the implementation depicted in FIG. 11, Body portion 1104 may be connected to discharge portion 1112 by a tongue portion 1114. In some embodiments, discharge portion 1112 has a substantially frustoconical shape that gradually increases in diameter. Discharge portion 1112 may terminate in a discharge flange 1116. Discharge flange 1116 may be coupled to a discharge line (e.g., discharge line 124, described above with reference to FIGS. 1-2) using multiple holes 1118.

The first axial flange 1102 is shown to include multiple holes 1110. In the implementation depicted in FIG. 11, the holes 1110 are blind threaded holes configured to receive threaded fasteners. The threaded fasteners may be threaded into the holes 1110 to couple a suction plate housing (e.g., suction plate housing 900) to the first axial flange 1102. The second axial flange 1106 is shown to include multiple holes

1108. In the implementation depicted in FIG. 11, the holes 1108 are through holes. Fasteners (e.g., bolts, screws) may be inserted through the holes 1108 and secured into threaded holes located on another component. In some embodiments, the threaded holes may be a feature of diffuser plate 1000. Collector 1100 may include any number and pattern of holes 1108, 1110, and 1118 required to couple the components of the multicomponent scroll.

In various embodiments, any or all of the suction plate 800, the suction plate housing 900, the diffuser plate 1000, and the collector 1100 may be fabricated using a casting process, using any suitable material. As described above with reference to FIG. 2, the casting process may be a "green sand" casting process. In addition, in various embodiments, certain components described above (e.g., suction plate 800 and suction plate housing 900) may be fabricated as unitary components and coupled to other components of the multicomponent scroll assembly (e.g., collector 1100) as described above.

The construction and arrangement of the systems and methods as shown in the various exemplary embodiments are illustrative only. Although only example embodiments have been described in detail in this disclosure, many modifications are possible (e.g., variations in sizes, dimensions, structures, shapes and proportions of the various elements, values of parameters, mounting arrangements, use of materials, colors, orientations, etc.). For example, the position of elements can be reversed or otherwise varied and the nature or number of discrete elements or positions can be altered or varied. Accordingly, such modifications are intended to be included within the scope of the present disclosure. The order or sequence of any process or method steps can be varied or re-sequenced according to alternative embodiments. Other substitutions, modifications, changes, and omissions can be made in the design, operating conditions and arrangement of the exemplary embodiments without departing from the scope of the present disclosure.

What is claimed is:

1. A centrifugal compressor assembly, comprising:

a scroll assembly comprising:

a suction plate comprising a first annular portion defining an inlet fluid passage, and a first outer flange extending outward from the first annular portion in a radial direction;

a suction plate housing comprising a second annular portion, blind threaded holes in the second annular portion, and a second outer flange extending outward from the second annular portion in the radial direction;

a first plurality of fasteners extending into the blind threaded holes to couple the first outer flange of the suction plate with the second annular portion of the suction plate housing;

a diffuser plate;

a diffuser passage defined between the diffuser plate and a portion of the suction plate housing;

a collector; and a second plurality of fasteners coupling the collector with the second outer flange of the suction plate housing; and an impeller rotatably mounted in the scroll assembly to compress a fluid introduced through the inlet fluid passage.

2. The centrifugal compressor assembly of claim 1, wherein the second annular portion of the suction plate housing extends in an axial direction perpendicular to the radial direction.

3. The centrifugal compressor assembly of claim 1, wherein the first annular portion of the suction plate axially overlaps with the second annular portion of the suction plate housing.

4. The centrifugal compressor assembly of claim 1, wherein the first annular portion of the suction plate comprises a first segment extending from a first side of the first outer flange of the suction plate and a second segment extending from a second side of the first outer flange, wherein the second segment axially overlaps with the second annular portion of the suction plate housing.

5. The centrifugal compressor assembly of claim 1, wherein at least one of the suction plate, the suction plate housing, the diffuser plate, or the collector is formed using a casting process.

6. The centrifugal compressor assembly of claim 1, wherein the diffuser plate comprises a curvilinear surface defining a portion of a collector passage, and the collector comprises an additional curvilinear surface defining an additional portion of the collector passage.

7. The centrifugal compressor assembly of claim 1, comprising at least one third fastener coupling the collector with the diffuser plate.

8. A scroll assembly of centrifugal compressor, comprising:

a suction plate comprising a first annular portion defining an inlet fluid passage, and a first outer flange extending outward from the first annular portion in a radial direction;

a suction plate housing comprising a second annular portion extending in an axial direction perpendicular to the radial direction, blind threaded holes in the second annular portion, and a second outer flange extending outward from the second annular portion in the radial direction;

a first plurality of fasteners extending into the blind threaded holes to couple the first outer flange of the suction plate with the second annular portion of the suction plate housing;

a diffuser plate;

a diffuser passage defined between the diffuser plate and a portion of the suction plate housing;

a collector; and a second plurality of fasteners coupling the collector with the second outer flange of the suction plate housing.

9. The scroll assembly of claim 8, comprising at least one third fastener coupling the collector with the diffuser plate.

10. The scroll assembly of claim 8, wherein the diffuser plate comprises a curvilinear surface defining a portion of a collector passage, and the collector comprises an additional curvilinear surface defining an additional portion of the collector passage.

11. The scroll assembly of claim 8, wherein the first annular portion of the suction plate axially overlaps with the second annular portion of the suction plate housing.

12. The scroll assembly of claim 8, wherein the first annular portion of the suction plate comprises a first segment extending from a first side of the first outer flange of the suction plate and a second segment extending from a second side of the first outer flange, wherein the second segment axially overlaps with the second annular portion of the suction plate housing.

13. A centrifugal compressor assembly, comprising:

a first scroll component comprising a first annular portion defining an inlet fluid passage, and a first outer flange extending outward from the first annular portion in a radial direction, wherein the first annular portion includes a first segment extending from a first side of the first outer flange and a second segment extending from a second side of the first outer flange;

a second scroll component comprising a second annular portion, blind threaded holes in the second annular portion, and a second outer flange extending outward from the second annular portion in the radial direction, wherein the second annular portion overlaps with the second segment of the first annular portion along an axial direction;

a first plurality of fasteners extending into the blind threaded holes to couple the first outer flange of the first scroll component with the second annular portion of the second scroll component;

a collector; and a second plurality of fasteners coupling the second outer flange of the second scroll component with the collector.

14. The centrifugal compressor assembly of claim 13, comprising:

a diffuser plate; and a diffuser passage defined between the diffuser plate and a portion of the second scroll component.

15. The centrifugal compressor assembly of claim 14, comprising a third plurality of fasteners coupling the collector with the diffuser plate.

16. The centrifugal compressor assembly of claim 14, wherein the diffuser plate comprises a curvilinear surface defining a portion of a collector passage, and the collector comprises an additional curvilinear surface defining an additional portion of the collector passage.

17. The centrifugal compressor assembly of claim 13, comprising an impeller configured to compress a fluid introduced through the inlet fluid passage.

18. The centrifugal compressor assembly of claim 13, wherein the second scroll component is positioned outward from the first scroll component relative to the radial direction.

* * * * *